US008272637B2

(12) United States Patent
Asada et al.

(10) Patent No.: US 8,272,637 B2
(45) Date of Patent: Sep. 25, 2012

(54) SHEET TRAY UNIT WITH THREE TRAY PORTIONS AND TRAY STOPPER, AND IMAGE RECORDING DEVICE COMPRISING SAID SHEET TRAY UNIT

(75) Inventors: Tetsuo Asada, Kuwana (JP); Masatoshi Izuchi, Cordova, TN (US)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 373 days.

(21) Appl. No.: 12/697,191

(22) Filed: Jan. 29, 2010

(65) Prior Publication Data

US 2010/0124449 A1 May 20, 2010

Related U.S. Application Data

(63) Continuation-in-part of application No. 12/361,536, filed on Jan. 28, 2009.

(30) Foreign Application Priority Data

Jan. 31, 2008 (JP) ..... 2008-021417
Jan. 30, 2009 (JP) ..... 2009-020445

(51) Int. Cl.
*B65H 1/00* (2006.01)

(52) U.S. Cl. ..... 271/171; 271/9.11

(58) Field of Classification Search ..... 271/171, 271/9.11

See application file for complete search history.

(56) References Cited

U.S. PATENT DOCUMENTS 5,313,257 A 5/1994 Kashima et al.
6,053,493 A 4/2000 Yokoyama et al.
6,287,032 B1 9/2001 Osmus et al.
2002/0117796 A1 8/2002 Miyamoto
2006/0071399 A1 4/2006 Asada et al.
2007/0147940 A1 6/2007 Hattori
2008/0012206 A1 1/2008 Koga et al.

(Continued)

FOREIGN PATENT DOCUMENTS

JP SHO61-130125 A 6/1986

(Continued)

OTHER PUBLICATIONS

Japan Patent Office; Notice of Reasons for Rejection in Japanese Patent Application No. 2008-021417 mailed May 12, 2010.

(Continued)

*Primary Examiner* — Gerald McClain
(74) *Attorney, Agent, or Firm* — Baker Botts L.L.P.

(57) ABSTRACT

A sheet tray unit includes a particular feed tray configured to hold one or more sheets therein, and a discharge tray disposed on the particular feed tray and configured to receive a discharged sheet. The discharge tray includes a first discharge tray portion, a second discharge tray portion, and a third discharge tray portion. The first discharge tray portion is configured to support the second discharge tray portion such that the second discharge tray portion selectively slides in a first direction and in a second direction, which is opposite and substantially parallel to the first direction. The second discharge tray portion is configured to support the third discharge tray portion such that the third discharge tray portion selectively slides in the first direction and in the second direction. The first discharge tray portion includes a stopper configured to limit the third discharge tray portion from sliding in the first direction beyond a predetermined position.

19 Claims, 13 Drawing Sheets

U.S. PATENT DOCUMENTS

| | | | | |
|---|---|---|---|---|
| 2008/0237977 | A1 | 10/2008 | Izuchi et al. | |
| 2009/0085279 | A1 * | 4/2009 | Wakakusa et al. | 271/145 |
| 2012/0001378 | A1 | 1/2012 | Izuchi et al. | |

FOREIGN PATENT DOCUMENTS

| | | | | |
|---|---|---|---|---|
| JP | H07-149452 | A | | 6/1995 |
| JP | 08026502 | A | * | 1/1996 |
| JP | H08-026502 | A | | 1/1996 |
| JP | H11-092011 | A | | 4/1999 |
| JP | 11343036 | A | * | 12/1999 |
| JP | 2000-247456 | A | | 9/2000 |
| JP | 2001-219621 | A | | 8/2001 |
| JP | 2002-068491 | A | | 3/2002 |
| JP | 2002-114434 | A | | 4/2002 |
| JP | 2002-249233 | A | | 9/2002 |
| JP | 2003-176039 | A | | 6/2003 |
| JP | 2004-331253 | A | | 11/2004 |
| JP | 2005-170626 | A | | 6/2005 |
| JP | 2006-082919 | A | | 3/2006 |
| JP | 2006-206319 | A | | 8/2006 |
| JP | 2006-341973 | A | | 12/2006 |
| JP | 2007-076751 | A | | 3/2007 |
| JP | 2007-169021 | A | | 7/2007 |
| JP | 2007-181933 | A | | 7/2007 |

OTHER PUBLICATIONS

Japan Patent Office, Notice of Reasons for Rejection for Japanese Patent Application No. 2009-020445, mailed Nov. 24, 2010.

Chinese Patent Office; Office Action in Chinese Patent Application No. 200910009930.2 mailed Jan. 30, 2011 (partial translation).

U.S. Patent and Trademark Office; Office Action in U.S. Appl. No. 12/361,536 mailed Mar. 23, 2011.

U.S. Patent and Trademark Office; Office Action in U.S. Appl. No. 12/361,536 mailed Oct. 5, 2011.

U.S. Patent and Trademark Office; Office Action in U.S. Appl. No. 12/361,536 mailed Jan. 23, 2011.

* cited by examiner

SHEET TRAY UNIT WITH THREE TRAY PORTIONS AND TRAY STOPPER, AND IMAGE RECORDING DEVICE COMPRISING SAID SHEET TRAY UNIT

CROSS REFERENCE TO RELATED APPLICATIONS

This application is a continuation-in-part of prior co-pending U.S. patent application Ser. No. 12/361,536, filed on Jan. 28, 2009, which claims priority from Japanese Patent Application No. 2008-021417, filed on Jan. 31, 2008, the entire disclosures of both the prior U.S. and Japanese patent applications being incorporated herein by reference. This application also claims priority from Japanese Patent Application No. 2009-020445, filed on Jan. 30, 2009, the entire disclosure of which is incorporated herein by reference.

BACKGROUND OF THE INVENTION

1. Field of the Invention

This application relates to a sheet tray unit comprising a feed tray for holding one or more sheets therein and a discharge tray for receiving a discharged sheet, and relates to an image recording device comprising such a sheet tray unit.

2. Description of Related Art

A known sheet tray unit for use in an image recording device comprises a tray configured to hold sheets therein and a tray cover configured to cover the sheets held in the tray. The tray cover also serves as a discharge tray for receiving a sheet discharged in a predetermined direction. The tray cover comprises an auxiliary discharge tray configured to extend from a main body of the tray cover in the predetermined direction.

In such a sheet tray unit, positional relations between the tray cover and the tray are relatively limited.

SUMMARY OF THE INVENTION

A need has arisen for a sheet tray unit that comprises a feed tray for holding sheets therein and a discharge tray for receiving a discharged sheet, and is configured to provide various positional relations between the feed tray and the discharge tray according to the sizes of sheets used or the amount of discharged sheets.

According to an embodiment of the invention, a sheet tray unit comprises a particular feed tray configured to hold one or more sheets therein, and a discharge tray disposed on the particular feed tray and configured to receive a discharged sheet. The discharge tray comprises a first discharge tray portion, a second discharge tray portion, and a third discharge tray portion. The first discharge tray portion is configured to support the second discharge tray portion such that the second discharge tray portion selectively slides in a first direction and in a second direction. The second direction is opposite and substantially parallel to the first direction. The second discharge tray portion is configured to support the third discharge tray portion such that the third discharge tray portion selectively slides in the first direction and in the second direction. The first discharge tray portion comprises a stopper configured to limit the third discharge tray portion from sliding in the first direction beyond a predetermined position.

According to another embodiment of the invention, an image recording device comprises a housing having an opening, a recording unit disposed in the housing and configured to record an image on a sheet, and a sheet tray unit configured to be removably inserted into the housing through the opening. The sheet tray unit comprises a particular feed tray configured to hold one or more sheets to be fed to the recording unit therein, and a discharge tray disposed on the particular feed tray and configured to receive a sheet discharged from the recording unit. The discharge tray comprises a first discharge tray portion, a second discharge tray portion, and a third discharge tray portion. The first discharge tray portion is configured to support the second discharge tray portion such that the second discharge tray portion selectively slides in a first direction and in a second direction. The second direction is an insertion direction of the sheet tray unit into the housing and is opposite to the first direction. The second discharge tray portion is configured to support the third discharge tray portion such that the third discharge tray portion selectively slides in the first direction and in the second direction. The first discharge tray portion comprises a stopper configured to limit the third discharge tray portion from sliding in the first direction beyond a predetermined position.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-15, like numerals being used for like corresponding parts in the various drawings.

Figure 1:
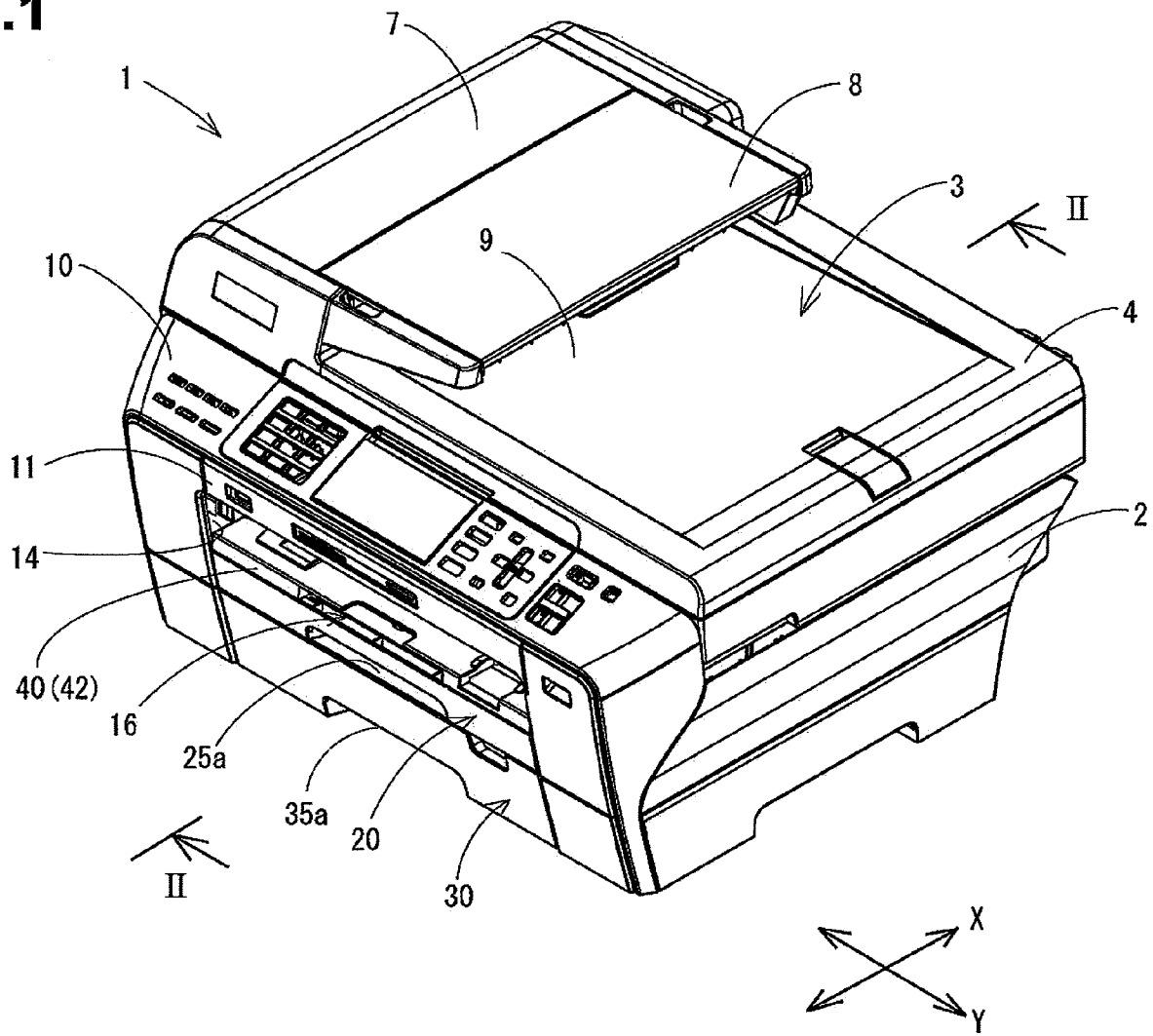
FIG. 1 is a perspective view of an image recording device, e.g., a multi-function device, according to an embodiment of the invention.

As shown in FIG. 1, an image recording device, e.g., a multi-function device 1, may perform one or more functions, e.g., printing, coping, scanning, facsimile functions, or any combination thereof.

Figure 2:
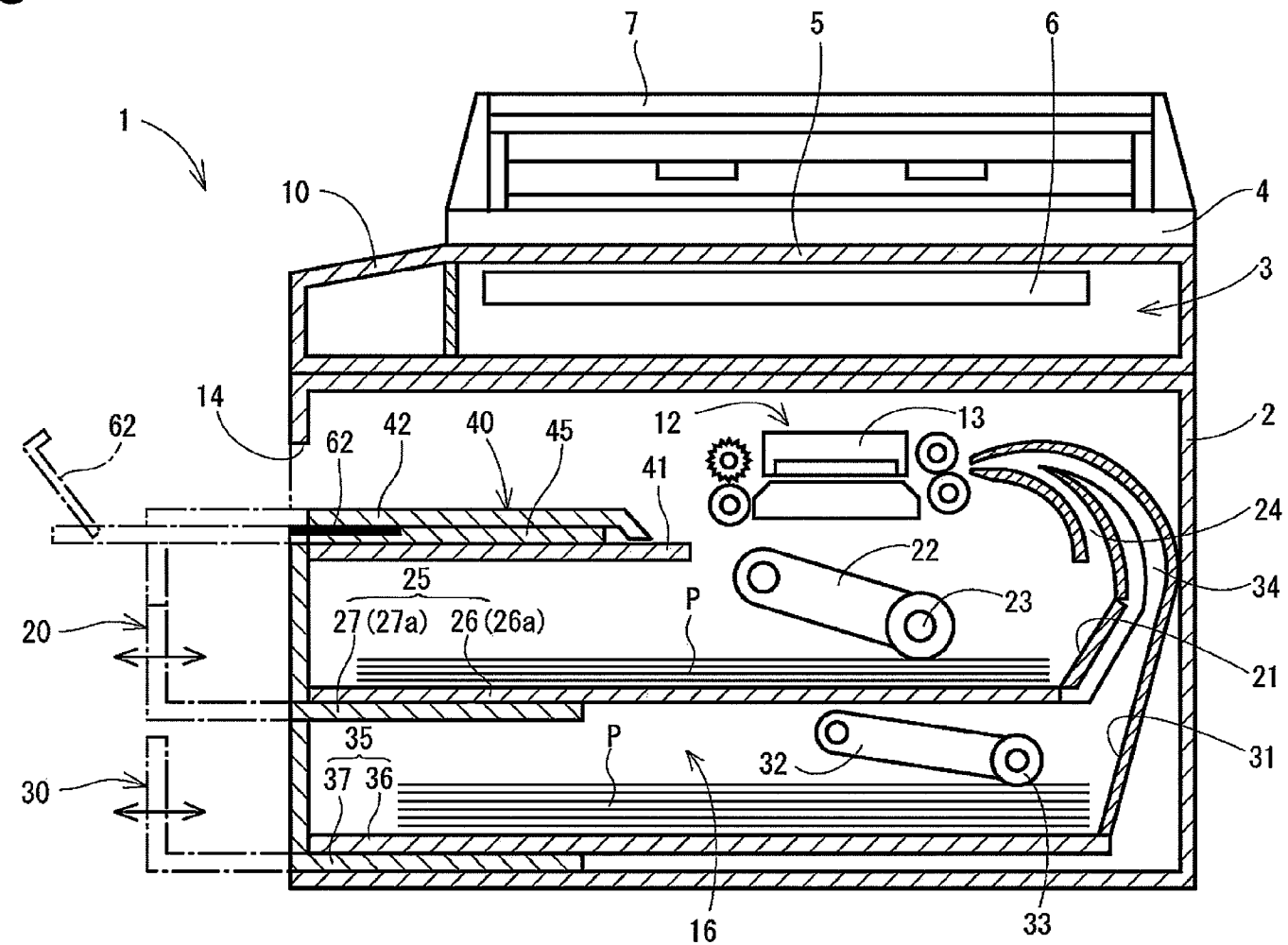
FIG. 2 is a side vertical cross-sectional view of the image recording device.

As shown in FIG. 2, the multi-function device 1 comprises a scanner 3 at the top of a housing 2 thereof. The scanner 3 performs coping and scanning functions by reading a document and creating image data, e.g., photograph data and text data.

Figure 3:
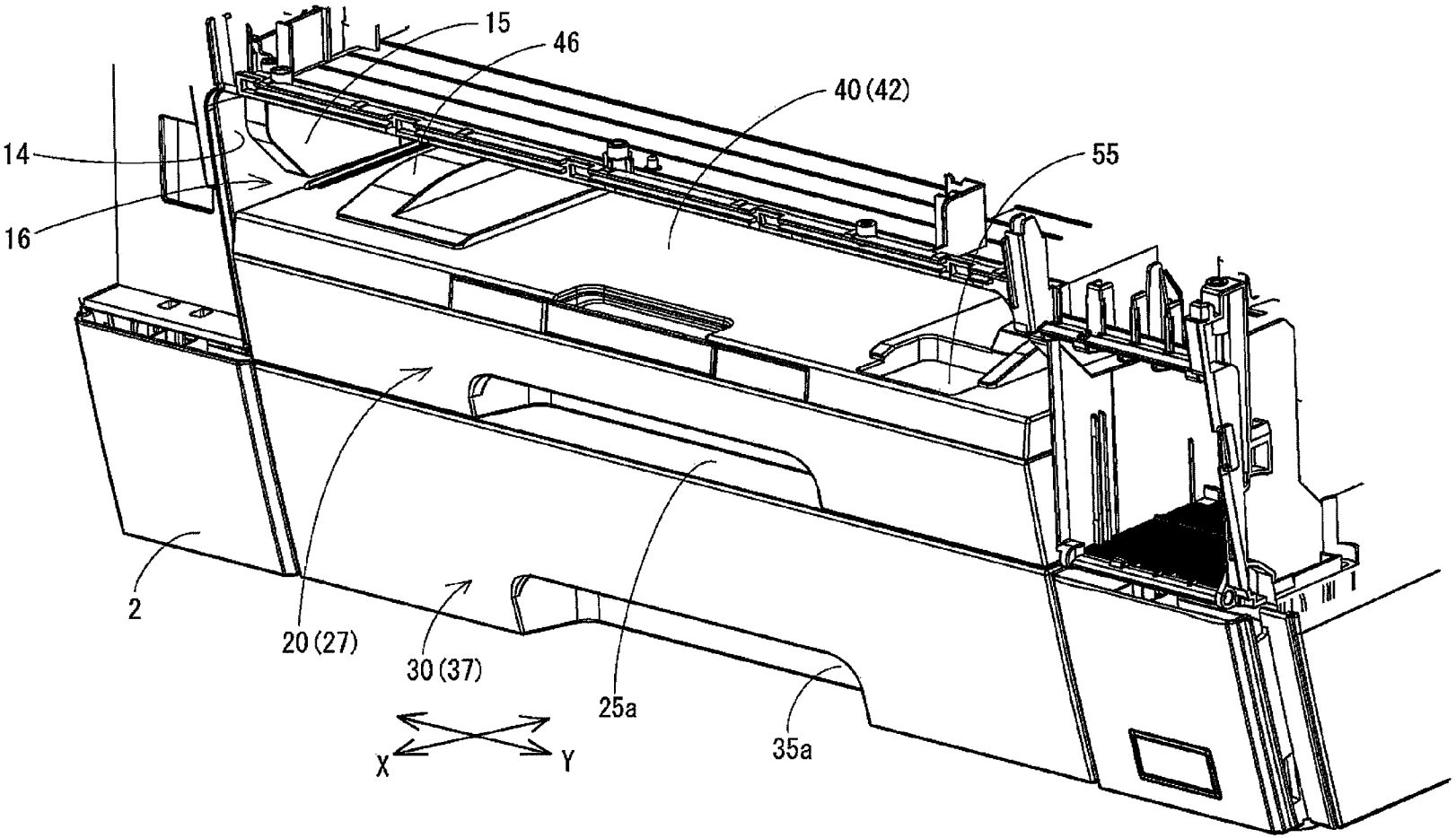
FIG. 3 is an enlarged view of a vicinity of an opening of the image recording device.

As shown in FIG. 3, the scanner 3 is a flatbed scanner and comprises a document cover 4 as a top plate of the multi-function device 1, a glass 5, and an image sensor 6. The document cover 4 is opened and closed, and the glass 5 and the image sensor 6 are disposed under the document cover 4. The image sensor 6 may be a contact image sensor (CIS) extending in an X-axis direction or a charge coupled devise (CCD). The image sensor 6 reciprocates in a Y-axis direction under the glass 5 and scans an image of a document placed on the glass 5.

The scanner 3 further comprises an automatic document feeder (ADF) 7 disposed on the document cover 4. The ADF 7 conveys documents placed on a document tray 8 sequentially, and the image sensor stopped under the glass 5 reads the documents. Then, the ADF 7 discharges the documents onto a document discharge tray 9.

An operation panel 10 is disposed on the front top of the multi-function device 1 and comprises operation buttons and a liquid crystal display. The operation panel 10 allows a user to instruct various operations. A slot unit 11 for receiving various small-sized memory cards is disposed below the operation panel 10.

As shown in FIGS. 2 and 3, a recording unit 12 is disposed at a central portion in the housing 2. The recording unit 12 comprises inkjet-type recording heads 13 and ink cartridges (not shown). Inks of various colors are supplied from the ink cartridges to the recording heads 13, respectively.

As shown in FIGS. 1 and 3, the multi-function device 1 has an opening 14 at the front bottom thereof. An upper feed tray 20 and a lower feed tray 30 are disposed in an accommodating portion 16 at the bottom of the housing 2. The upper and lower feed trays 20, 30 may be inserted into and removed from the accommodating portion 16 substantially horizontally through the opening 14 along the X-axis direction.

In the following description, the expressions "front", "rear", "upper", "lower", "right", and "left" are used to define the various parts when the multi-function device 1 is disposed in an orientation in which it is intended to be used. When the multi-function device 1 is used, the opening 14 faces frontward. A front-rear direction corresponds to the X-axis direction, and a right-left direction corresponds to the Y-axis direction.

A guide 15 shaped like a rail is disposed on each of right and left inner side surfaces that partially define the opening 14. FIG. 3 shows a part of the guide 15. The guides 15 guide the upper feed tray 20 such that the upper and lower feed trays 20, 30 are inserted correctly into the accommodation portion 16. The guides 15 are disposed so as to contact an upper surface of a discharge tray 40.

Each of the upper and lower feed trays 20, 30 is configured to hold therein a stack of recording media, e.g., a stack of sheets P. Sheets P are fed from each of the feed trays 20, 30 in a direction parallel to a direction in which the feed trays 20, 30 are inserted into the housing 2. The lower feed tray 30 may be configured to hold therein more sheets than the upper feed tray 20.

An upper separation plate 21 is disposed at a rear end of the upper feed tray 20, i.e., at a downstream end of the upper feed tray 20 in the sheet feed direction (at a right end of the upper feed tray 20 in FIG. 2). An upper feed roller 23 is rotatably supported at a distal end of an upper feed arm 22 and opposes a bottom surface of the upper feed tray 20, at a position adjacent to the rear end of the upper feed tray 20. The upper feed arm 22 is urged downward such that the feed roller 23 contacts an uppermost one of the sheets P in the upper feed tray 20. The upper feed roller 23, when driven to rotate, cooperates with the upper separation plate 21 to separate the uppermost sheet P upward.

A conveying path 24 is formed from the upper feed tray 20 upward along the upper separation plate 21, curves in a U-shape toward the front of the multi-function device 1. After the recording unit 12 records an image on the sheet P, the sheet P is discharged onto the upper surface of the discharge tray 40. The upper feed arm 22 is configured to move up and down when the upper feed tray 20 is inserted into and removed from the accommodating portion 16. This prevents the upper feed roller 23 from colliding with the upper separation plate 21.

The lower feed tray 30 is configured similarly to the upper feed tray 20. A lower separation plate 31 is disposed at a downstream end of the lower feed tray 30 in the sheet feed direction (at a right end of the lower feed tray 30 in FIG. 2). A lower feed roller 33 is rotatably supported at a distal end of a lower feed arm 32 and opposes a bottom surface of the lower feed tray 30, at a position adjacent to the rear end of the lower feed tray 30. The lower feed arm 32 is urged downward such that the lower feed roller 33 contacts an uppermost one of the sheets P in the lower feed tray 30. The lower feed roller 33, when driven to rotate, cooperates with the lower separation plate 31 to separate the uppermost sheet P upward.

A conveying path 34 is formed outside the conveying path 24. The conveying path 34 is formed from the lower feed tray 30 upward along the lower separation plate 31, curves in a U-shape toward the front of the multi-function device 1. After the recording unit 12 records an image on the sheet P, the sheet P is discharged onto the upper surface of the discharge tray 40. The lower feed arm 32 is configured to move up and down when the lower feed tray 30 is inserted into and removed from the accommodating portion 16. This prevents the lower feed roller 33 from colliding with the lower separation plate 31.

As shown in FIG. 2, the discharge tray 40 is disposed above an upper sheet holding portion 25 of the upper feed tray 20. Sheets P selectively fed from the upper feed tray 20 and the lower feed tray 30 are discharged onto the discharge tray 40 and stacked sequentially from the bottom. Because the lower feed tray 30 is substantially the same as the upper feed tray 20 except that the discharge tray 40 is provided only for the upper feed tray 20. Thus, the structure of the upper feed tray 20 is only described herein in detail.

The upper sheet holding portion 25 of the upper feed tray 20 has a box shape and is open upward. The discharge tray 40 also serves as a cover for protecting the sheets P in the upper sheet holding portion 25 from dust or the like. The discharge tray 40 has a thin flat plate shape, and covers an upper opening of the upper sheet holding portion 25 while exposing the upper feed arm 22.

The discharge tray 40 comprises a first discharge tray portion 41, a second discharge tray portion 42, and a third discharge tray portion 45. The first discharge tray portion 41 is disposed above a first feed tray portion 26 of the upper feed tray 20. The second discharge tray portion 42 is configured to slidably extend and retract with respect to the first discharge tray portion 41 along a direction in which the upper feed tray 20 is inserted, i.e., the X-axis direction.

The upper sheet holding portion 25 is defined by the first feed tray portion 26 and a second feed tray portion 27. The first feed tray portion 26 is positioned at a downstream side of the housing 2 in the insertion direction (X-axis direction), i.e., at a right side of the housing 2 in FIGS. 2 and 3. The second feed tray portion 27 is configured to slide along the insertion direction (X-axis direction) with respect to the first feed tray portion 26. Specifically, as shown in FIG. 2, a sheet holding plate 26*a* of the first feed tray portion 26 lies over a sheet holding plate 27*a* of the second feed tray portion 27. A handle 25*a* is formed at a front surface of the second feed tray portion 27.

As described later, the second feed tray portion 27 may be configured to slide with respect to the first feed tray portion 26 and to be selectively locked at three positions, e.g., at a retracted position, an extended position, and an intermediate position therebetween. When the second feed tray portion 27 is fully extended, along the X-axis direction, from the first feed tray portion 26, the upper feed tray 20 is allowed to hold up to A3 size sheets with their long side parallel to the X-axis direction. When the second feed tray portion 27 is fully retracted, along the X-axis direction, to the first feed tray portion 26, the upper feed tray 20 is allowed to hold up to A4 size sheets with their long side parallel to the X-axis direction.

A pair of side guides 28 is provided for the upper sheet holding portion 25 and guides side edges of the sheets that extend parallel to the X-axis direction. A distance in the Y-axis direction between the side guides 28 is adjusted such that the Y-axis center of the sheets is aligned with a reference center position of the upper sheet holding portion 25 regardless of the size of the sheets. The upper sheet holding portion 25 is allowed to hold sheets of L size to A3 size by the adjustment of the side guides 28 and by the extension and retraction of the second feed tray portion 27 with respect to the first feed tray portion 26. A rear guide (not shown) may also be provided in the upper sheet holding portion 25 so as to guide trailing edges of the sheets.

In the lower feed tray 30, the lower sheet holding portion 35 is defined by a first feed tray portion 36 and a second feed tray portion 37. The first feed tray portion 36 is positioned at a downstream side of the housing 2 in the insertion direction (X-axis direction), i.e., at a right side of the housing 2 in FIGS. 2 and 3. The second feed tray portion 37 is configured to slide along the insertion direction (X-axis direction) with respect to the first feed tray portion 36. The second feed tray portion 37 may be selectively locked at two positions, e.g., at a retracted position and an extended position. Further, the second feed tray portion 37 may be locked at an intermediated position between the retracted and extended positions. When the second feed tray portion 37 is fully extended, along the X-axis direction, from the first feed tray portion 36, the lower feed tray 30 is allowed to hold up to A3 size sheets with their long side parallel to the X-axis direction. When the second feed tray portion 37 is fully retracted, along the X-axis direction, to the first feed tray portion 36, the lower feed tray 30 is allowed to hold up to A4 size sheets with their long side parallel to the X-axis direction.

A pair of side guides (not shown) is provided for the lower sheet holding portion 35 and guides side edges of the sheets. A distance between the side guides are adjusted such that the Y-axis center of the sheets is aligned with a reference center position of the lower sheet holding portion 35 regardless of the size of the sheets. A handle 35*a* is formed at a front surface of the lower feed tray 30.

Figure 5A:
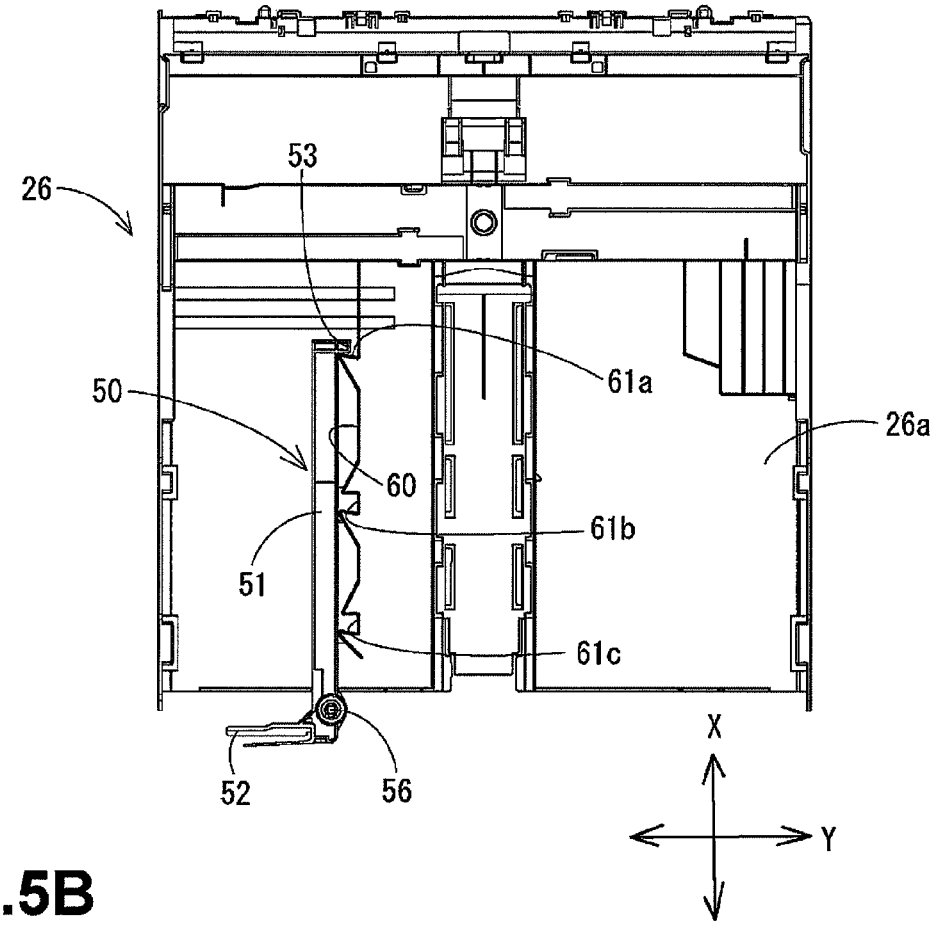
FIG. 5A is a bottom view of a first feed tray portion of the upper feed tray.
Figure 5B:
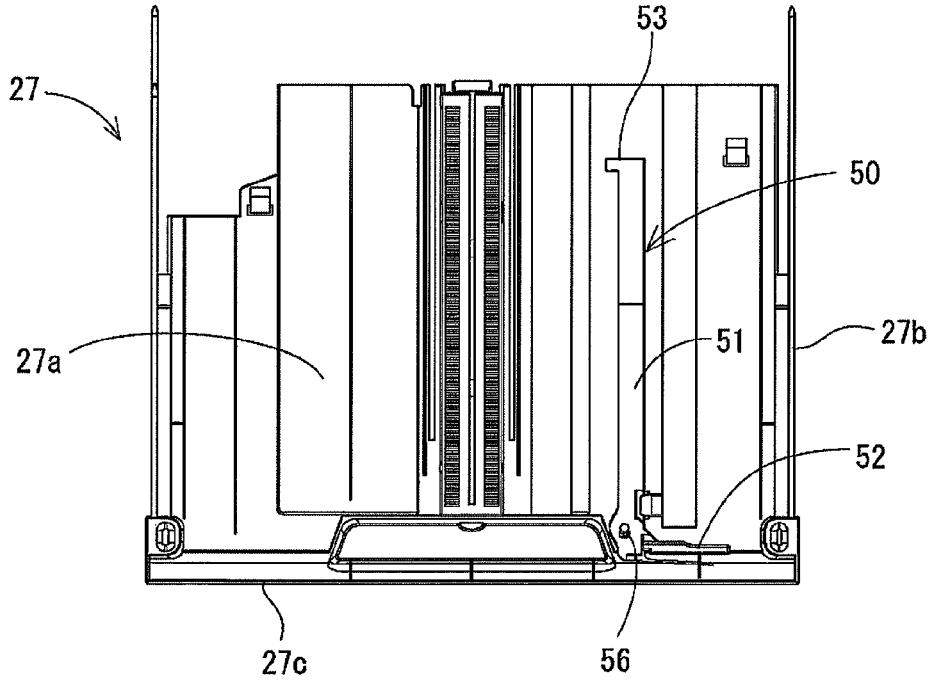
FIG. 5B is a top view of a second feed tray portion of the upper feed tray.

As shown in FIGS. 5A and 5B, the upper feed tray 20 comprises a locking unit 50 configured to lock the second feed tray portion 27 at the extended and retracted positions and to permit the second feed tray portion 27 to slide along the X-axis direction. The locking unit 50 prevents the second feed tray portion 27 from extending and retracting accidentally.

The locking unit 50 comprises a rod 51 disposed on an upper surface of the sheet holding plate 27*a* of the second feed tray portion 27 at a position closer to one of the side plates 27*b* of the second feed tray portion 27, i.e., a side plate 27*b* on the right in FIG. 5B. The rod 51 extends in the insertion direction (X-axis direction) and is supported by a shaft 56 so as to pivot about the shaft 56 horizontally. The shaft 56 projects at a position adjacent to a front plate 27*c* of the second feed tray portion 27.

An operating handle 52 of the rod 51 is bent into an L-shape and extends from the shaft 56 along the front plate 27*c* in the Y-axis direction. One end of the rod 51 opposite to the operating handle 52 is bent into an L-shape to form a projection 53 directed to a center line, parallel to the Y-axis direction, of the second feed tray portion 27.

A guide rail 60 is formed integrally with a lower surface of the sheet holding plate 26*a* of the first feed tray portion 26 so as to extend in the X-axis direction. A plurality of recesses, e.g., three recesses 61*a*-61*c*, are formed in the guide rail 60. The recesses 61*a*-61*c* are open sideward such that the projection 53 is selectively engaged with the recesses 61*a*-61*c*.

Specifically, the locking unit 50 locks the second feed tray portion 27 at three positions. When the projection 53 is engaged with the recess 61*a* formed at the most downstream position in the insertion direction (X-axis direction), the second feed tray portion 27 is locked at a fully retracted position to the first feed tray portion 26. In this state, the upper sheet holding portion 25 is adjusted to hold up to A4 size sheets with their long side parallel to the X-axis direction.

When the projection 53 is engaged with the recess 61*c* formed at the most upstream position in the insertion direction (X-axis direction), the second feed tray portion 27 is locked at a fully extended position from the first feed tray portion 26. In this state, the upper sheet holding portion 25 is adjusted to hold up to A3 size sheets with their long side parallel to the X-axis direction.

When the projection 53 is engaged with the recess 61*b* formed between the recesses 61*a*, 61*c*, the second feed tray portion 27 is locked at an intermediate position between the fully retracted and extended positions. In this state, the upper sheet holding portion 25 is adjusted to hold up to legal size sheets with their long side parallel to the X-axis direction.

When the projection 53 is not engaged with any of the recesses 61*a*-61*c*, the second feed tray portion 27 is unlocked and allowed to slide along the X-axis direction. The guide rail 60 has surfaces slanted with respect to the X-axis direction between the recesses 61*a*, 61*b* and between the recesses 61*b*, 61*c*. These slanted surfaces help the projection 53 to smoothly engage with and disengage from the recesses 61*a*-61*c*.

In another embodiment, the second feed tray portion 27 may be locked at two positions, i.e., a fully retracted position and a fully extended position with respect to the first feed tray portion 26. In still another embodiment, the second feed tray portion 27 may be locked at four or more positions with respect to the first feed tray portion 26.

The second tray 42 portion has a through-hole 55 formed at a front right portion thereof. The operating handle 52 of the rod 51 is exposed through the through-hole 55. The operating handle 52 is positioned below the through-hole 55 and is accessible and operable through the through-hole 55, especially easily by the right hand of a user.

When the user touches the operating handle 52 with his/her fingers inserted into the through-hole 55 and pushes the operating handle 52 frontward (outward), the rod 51 and the operating handle 52 pivots clockwise horizontally about the shaft 56, and the projection 53 disengages from the recess 61*a* (61*b*, 61*c*).

For example, when the user pulls the second discharge tray portion 42 frontward (outward) from the opening 14 while the projection 53 is engaged with the recess 61*a*, by placing the index finger on the operating handle 52 and the thumb on the front surface of the second feed tray portion 27 or the second discharge tray portion 42, the second feed tray portion 27 and the second discharge tray portion 42 are pulled out along the X-axis direction integrally with each other because of engagement between recesses 44 and bosses 29. The second feed tray portion 27 is unlocked and movable frontward and rearward freely together with the second discharge tray portion 42 until the projection 53 engages with the recess 61*c* or the recess 61*b*. A unitary movement of the second feed tray portion 27 and the second discharge tray portion 42 facilitates adjustment of the upper feed tray 20 in accordance with the size of the sheets held therein.

The through-hole 55, which is formed at the front of the second discharge tray portion 42, may also be used for checking the amount of sheets remaining in the upper feed tray 20.

Figure 4A:
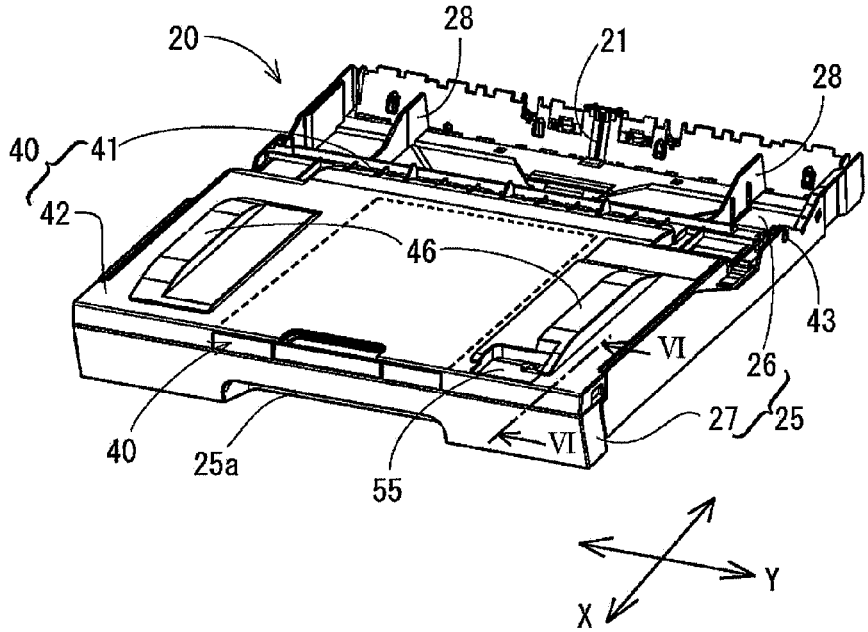
FIG. 4A is a perspective view of an upper feed tray of the image recording device, in which the upper feed tray is in a retracted state.
Figure 4B:
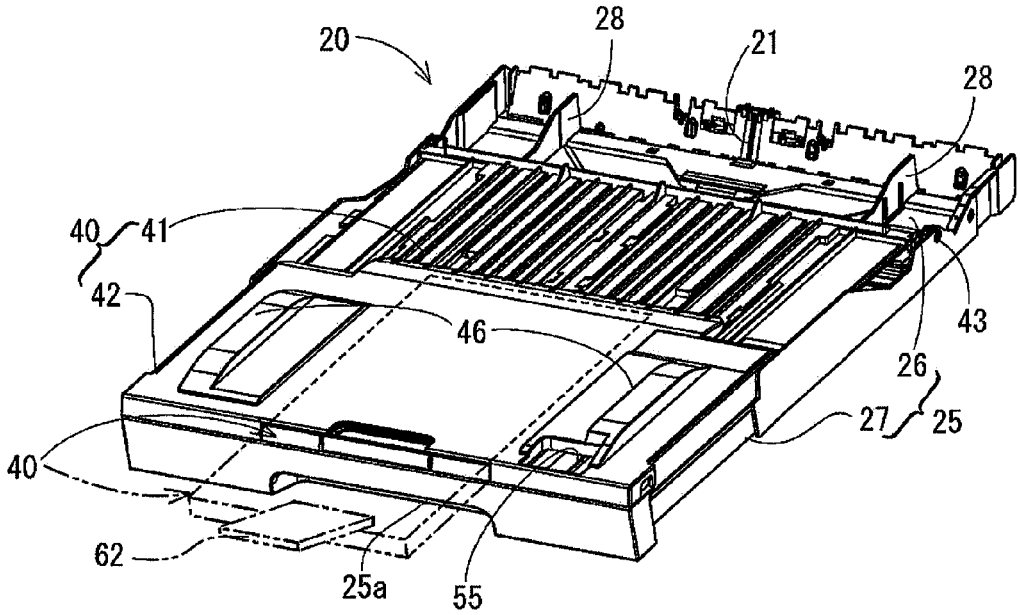
FIG. 4B is a perspective view of the upper feed tray of the image recording device, in which the upper feed tray is in an extended state.

As shown in FIGS. 4A and 4B, the first discharge tray portion 41 is coupled to the first feed tray portion 26 via a hinge 43 such that the first discharge tray portion 41 pivots about an axis extending in the Y-axis direction with respect to the upper sheet holding portion 25. This allows the user to raise the front end of the discharge tray 40 and set the sheets in the upper sheet holding portion 25 after the user removes the upper feed tray 20 from the housing 2 or pulls out the upper feed tray 20 relatively greatly from the housing 2.

As shown in FIGS. 2 and 11A-11C, the first discharge tray portion 41 lies under the second discharge tray portion 42. The third discharge tray portion 45 is vertically interposed between the first discharge tray portion 41 and the second discharge tray portion 42. A pair of ribs 46 projects from an upper surface of the second discharge tray portion 42 and extends along the X-axis direction. Depending on the size of a discharged sheet, the ribs 46 guide widthwise edges of a discharged sheet, or orient widthwise edges of a discharged sheet upward thereby to prevent drooping of a leading edge of the discharged sheet.

Figure 10:
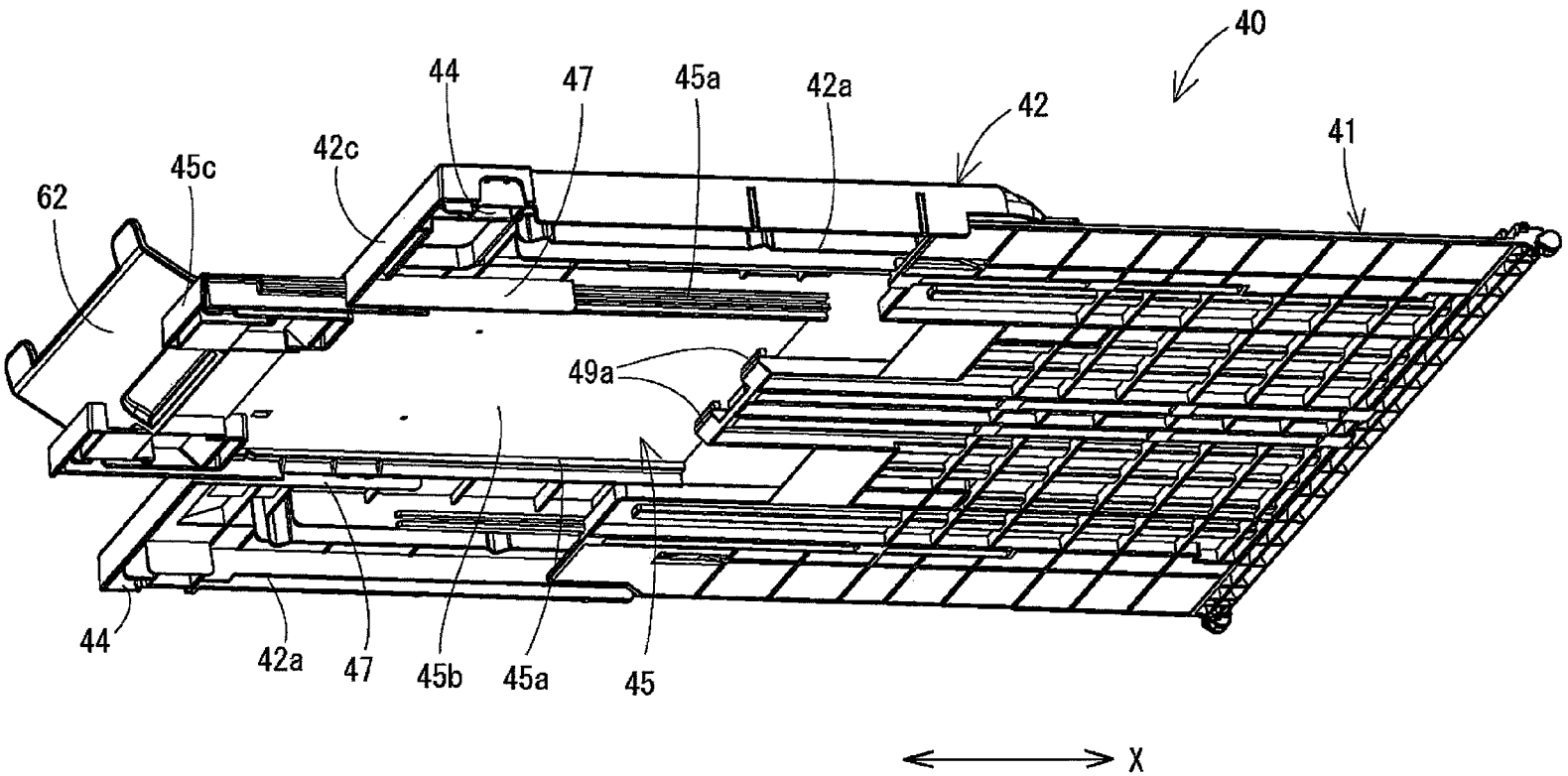
FIG. 10 is a bottom perspective view of the discharge tray in a state of FIG. 9B.

As shown in FIG. 10, the first discharge tray portion 41 supports the second discharge tray portion 42 such that the second discharge tray portion 42 slides along the X-axis direction. The second discharge tray portion 42 slides between a fully retracted position shown in FIG. 4A and a fully extended position shown in FIG. 4B with respect to the first discharge tray portion 41. The second discharge tray portion 42 slides on an upper surface of the first discharge tray portion, while guide members 42*a* formed at opposed widthwise edges of the second discharge tray portion 42 make slide-contact with the first discharge tray portion 41.

Figure 12:
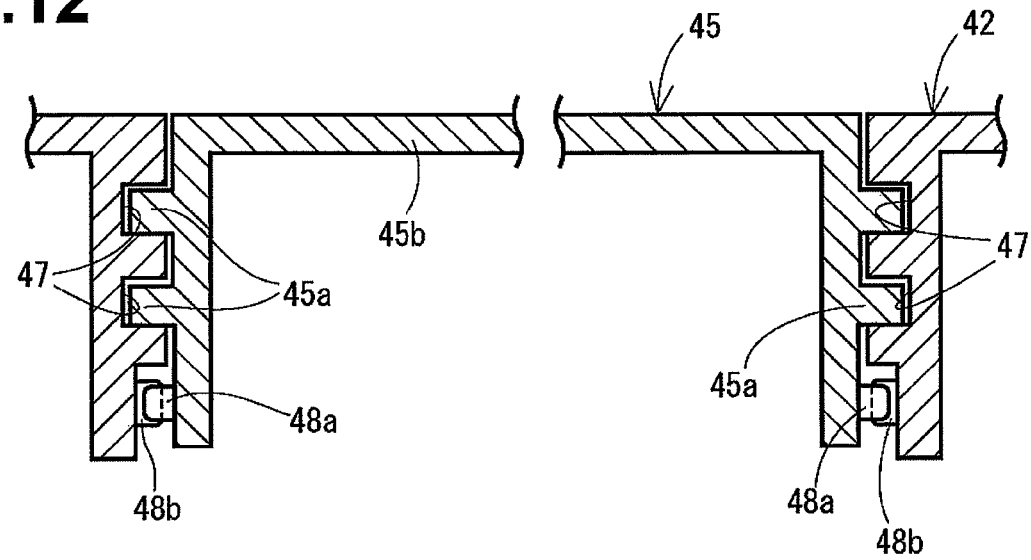
FIG. 12 is a cross-sectional view of the third discharge tray portion slidably supported by the second discharge tray portion.

The second discharge tray portion 42 supports the third discharge tray portion 45 such that the third discharge tray portion slides, along the X-axis direction, between a lower surface of the second discharge tray portion and an upper surface of the first discharge tray portion 41. As shown in FIGS. 10 and 12, guide rails 45*a* are formed at opposed widthwise edges of the third discharge tray portion 45 and extend along the X-axis direction. The guide rails 45*a* are slidably supported by respective guide grooves 47 formed at opposed inward portions, with respect to Y-axis direction, of a lower surface of the second discharge tray portion 42.

Figure 6:
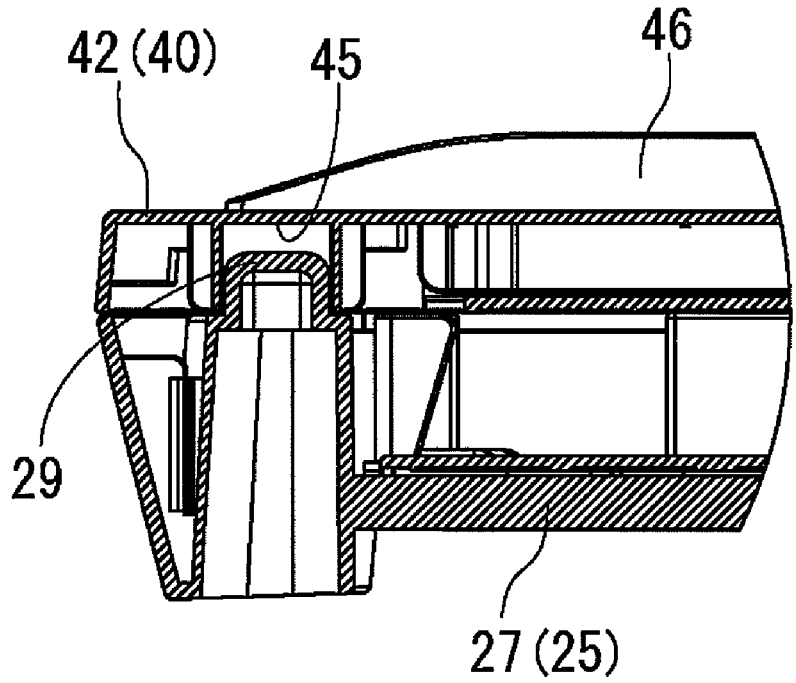
FIG. 6 is an enlarged cross-sectional view taken along line VI-VI of FIG. 4A.
Figure 8:
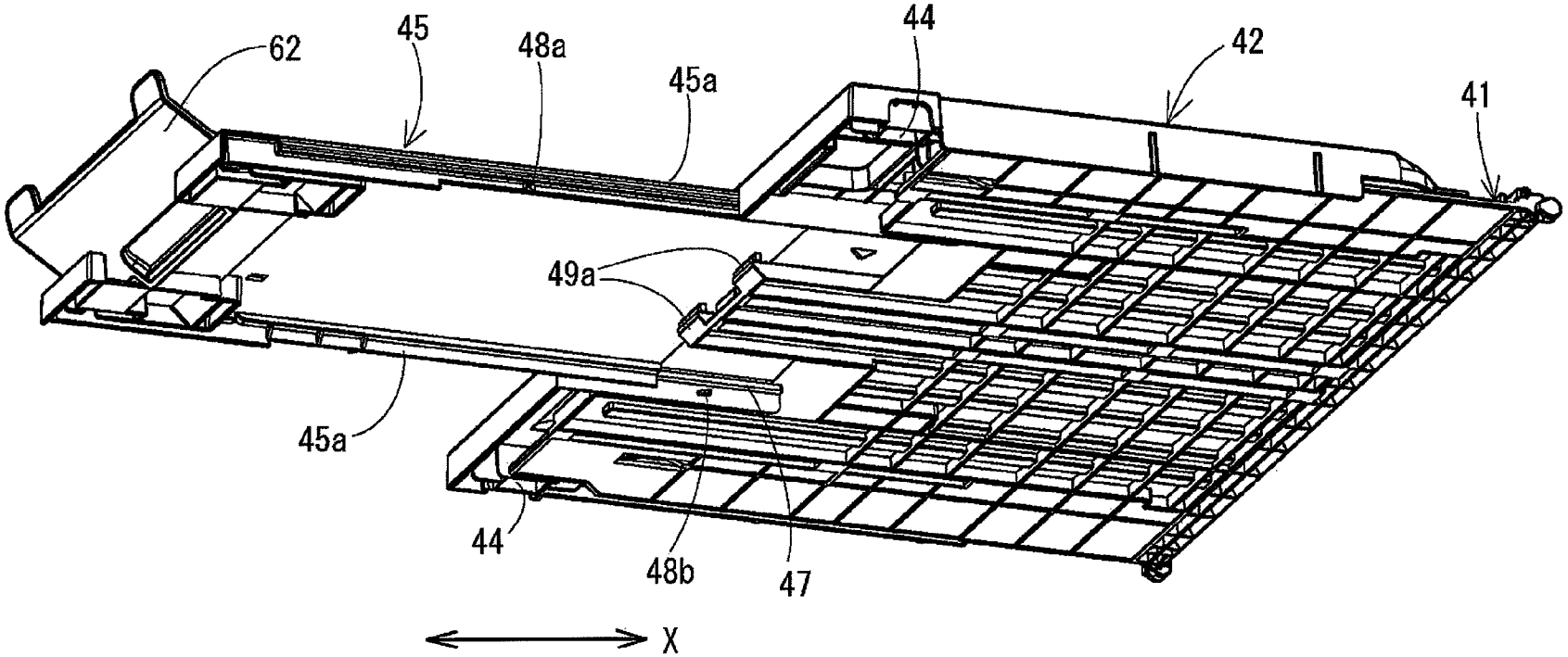
FIG. 8 is a bottom perspective view of the discharge tray in a state shown in FIG. 7C.

As shown in FIGS. 6, 8, and 10, the recesses 44 are formed to be open downward at widthwise edge portions (right and left edge portions) of the front side (near the opening 14) of the lower surface of the second discharge tray portion 42. As shown in FIG. 6, the boss 29 projects from each of widthwise edge portions of the front side of the second feed tray portion 27. As shown in FIGS. 4A and 4B, while the bosses 29 are engaged in the respective recesses 44, the second discharge tray portion 42 and the second feed tray portion 27 are extended and retracted integrally with each other with respect to the first feed tray portion 26. The second discharge tray portion 42 slides along the X-axis direction as the second feed tray portion 27 slide along the X-axis direction.

As shown in FIG. 3, guide members 15 partially defining the opening 14 is configured to contact widthwise edges of an upper surface of the second discharge tray portion 42. The guide members 15 prevent vertical rattling of the second discharge tray portion 42 and the second feed tray portion 27 when they are extended from the opening 14. When the upper feed tray 20 is inserted into the opening 14, the second discharge tray portion 42 is not allowed to pivot about the hinge 43.

The first discharge tray portion 41 has a length L1 in the X-axis direction, the second discharge tray portion 42 has a length L2 in the X-axis direction, and the third discharge tray portion 45 has a length L3 in the X-axis direction. In this case, L3 is set to be smaller than L1 and L2.

Figure 7A:
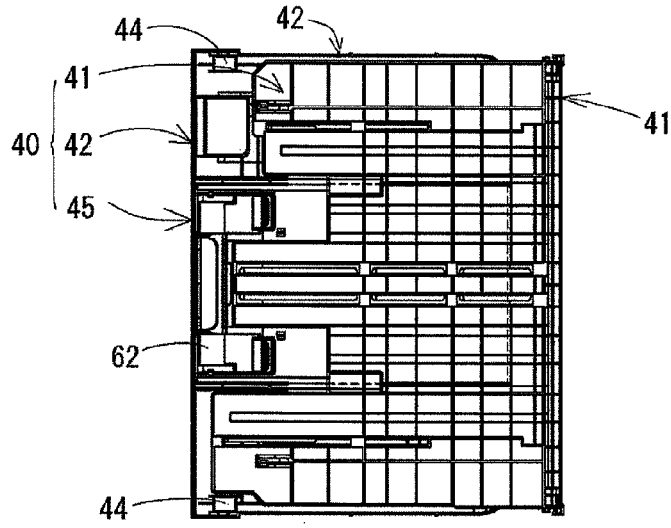
FIG. 7A is a bottom view of a discharge tray in a fully retracted state.
Figure 7B:
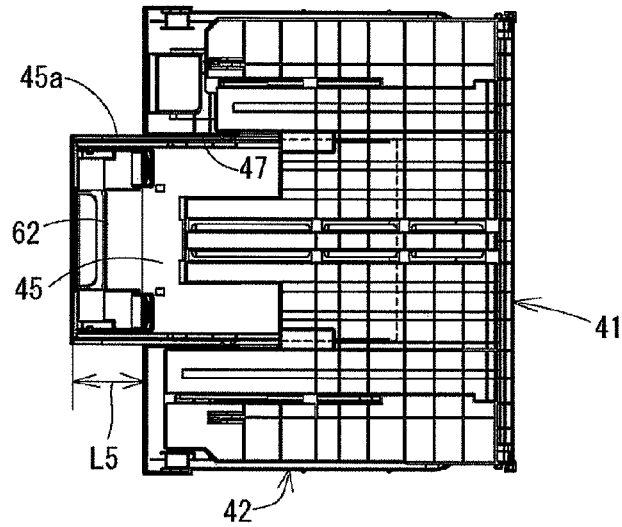
FIG. 7B is a bottom view of the discharge tray in which a third discharge tray portion is extended by a relatively small length from a second discharge tray portion.
Figure 7C:
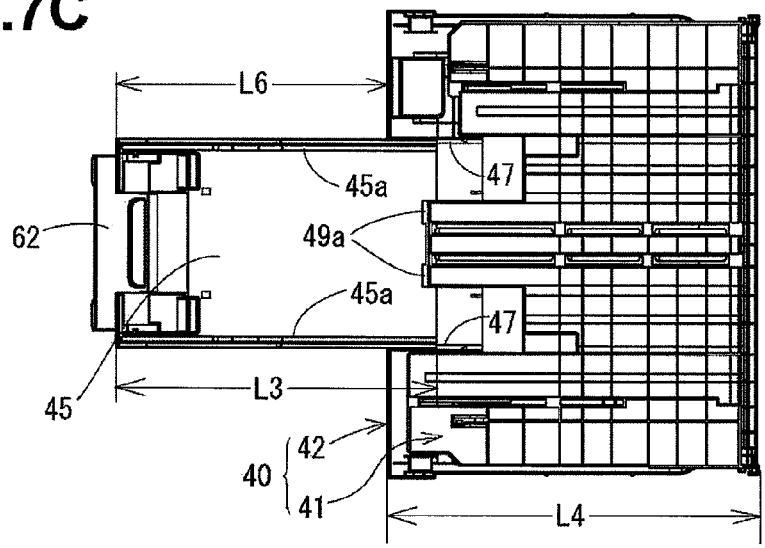
FIG. 7C is a bottom view of the discharge tray in which the third discharge tray portion is extended by a relatively great length from the second discharge tray portion.

FIGS. 7A, 7B, and 7C show a state where the second discharge tray portion 42 is at a fully retracted position (herein after referred to as retracted position J) to the first discharge tray portion 41. As shown in FIG. 7C, when the second discharge tray portion 42 is at the retracted position J, a length from the most downstream end of the first discharge tray portion 41 in the insertion direction of the upper feed tray 20 to the most upstream end of the second discharge tray portion 42 in the insertion direction is L4, which is set to be greater than L1 and L2. When the second discharge tray portion 42 is at the retracted position J, the first discharge tray portion 41 and the second discharge tray portion 42 overlap each other for the most part. The downstream end of the first discharge tray portion 41 slightly projects from the second discharge tray portion 42, and the upstream end of the second discharge tray portion 42 slightly projects from the first discharge tray portion 41.

As shown by FIG. 7B, the third discharge tray portion 45 is held, by a first engaging unit, at a position (referred to as extended position E) where the third discharge tray portion 45 is extended by a length L5 from the second discharge tray portion 42 located at the position J. As shown in FIGS. 8 and 12, the first engaging unit comprises an outward engaging member 48*a* projecting from a longitudinally intermediate portion of the each of the guide rails 45*a* of the third discharge tray portion 45, and an inward engaging member 48*b* projecting from a longitudinally intermediate portion of a corresponding one of the guide grooves 47. When the third discharge tray portion 45 is pulled out from the second discharge tray portion 42 located at the retracted position J, the outward engaging members 48*a* contact the corresponding inward engaging members 48*b*. This generates a sensory feedback, e.g., an audible click, thereby allowing the user to recognize that the third discharge tray portion 45 is at the extended position E.

Figure 13:
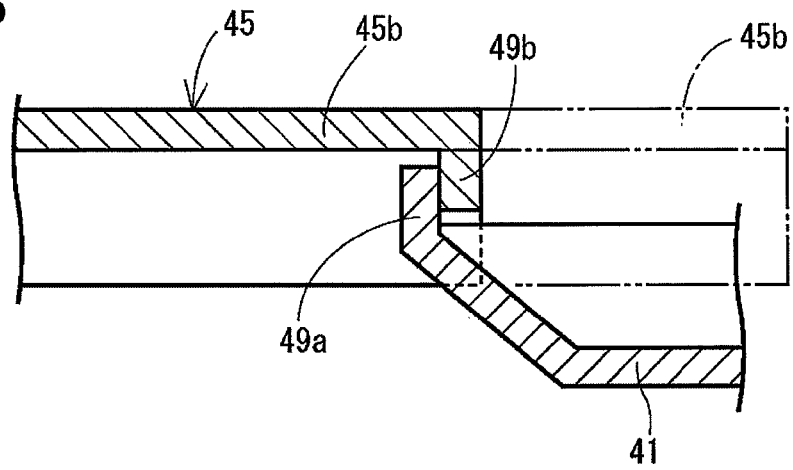
FIG. 13 is a cross-sectional view of the third discharge tray portion stopped by the first discharge tray portion from extending any further.

As shown in FIG. 7C, the third discharge tray portion 45 is held, by a second engaging unit, at a position (hereinafter referred to as extended position F) where the third discharge tray portion 45 is extended by a length L6 from the second discharge tray portion 42 located at the retracted position J. As shown in FIGS. 8, 10, and 13, the second engaging unit comprises at least one upward engaging member 49*a*, e.g. two upward engaging members, formed at the upstream end of the first discharge tray portion 41 in the insertion direction of the upper feed tray 20, and at least one downward engaging member 49*b* formed at a flat plate 45*b* of the third discharge tray portion 45. When the third discharge tray portion 45 is extended by the length L6 from the second discharge tray portion 42, the upward engaging members 49*a* engages with the at least one downward engaging member 49*b*, thereby to limit the third discharge tray portion 45 from sliding further in a sheet discharging direction, i.e., a direction opposite to the insertion direction. In other words, the upward engaging member 49*a* of the first discharge tray portion 41 serves as a stopper that limits the third discharge tray portion 45 from sliding in the sheet discharging direction beyond a predetermined position. When the third discharge tray portion 45 is extended by the length L6 from the second discharge tray portion 42, a downstream end of the third discharge tray portion 45 in the sheet discharging direction reaches the predetermined position. As shown in FIG. 13, the downward engaging member 49*b* may be formed at the downstream end of the flat plate 45*b* in the insertion direction, or the flat plate 45*b* may extend, as shown by double dashed lines, such that the downward engaging member 49*b* is positioned upstream of the downstream end of the flat plate 45*b*.

As shown in FIG. 7A, the third discharge tray portion 45 is held, by a third engaging unit, at a fully retracted position (referred to as non-use position G) to the second discharge tray portion 42 located at the retracted position J. When the third discharge tray portion 45 is in the non-use position G, a front plate 42*c* of the second discharge tray portion 42 and a front plate 45*c* of the third discharge tray portion 45 are aligned with each other, as shown in FIGS. 3 and 7A. The third engaging unit comprises a rear surface of the front plate 45*c* or a rear surface of a thick portion of the front plate 45*c*, and the upstream end of each of the guide grooves 47.

The third discharge tray portion 45 comprises a sheet stopper 62 configured to pivot between a lying position and a standing position. The sheet stopper 62 receives and stops leading edges of discharged sheets from moving further downstream in a sheet discharge direction. When the sheet stopper 62 is in the lying position, an upper surface of the sheet stopper 62 is flush with an upper surface of the third discharge tray portion 45. As shown in FIGS. 2, 8, and 10, when the sheet stopper 62 is in the standing position, the sheet stopper 62 projects upward slantingly beyond the front plate 45*c*. A base portion of the sheet stopper 62 is supported, via a pivot shaft (not shown), by the third discharge tray portion 45 so as to pivot vertically. The sheet stopper 62 prevents discharged sheets including A3 size sheets, which are long in the X-axis direction, from projecting beyond the third discharge tray portion 45 and helps staking the discharged sheets orderly on the discharge tray 40.

Figure 14:
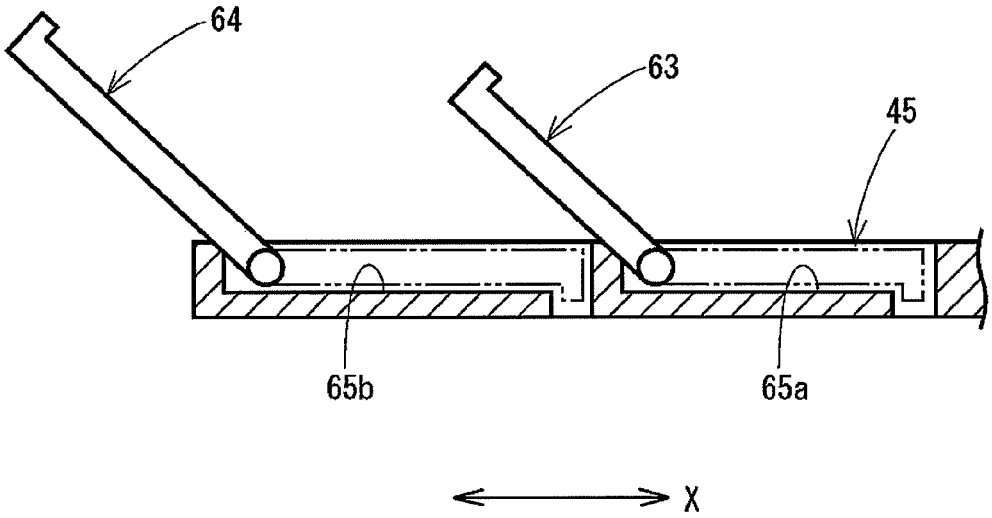
FIG. 14 is a cross-sectional view of sheet stoppers of a discharge tray according to an embodiment of the invention.

In another embodiment, as shown in FIG. 14, sheet stoppers 63, 64 may be arranged at intervals in the X-axis direction and configured to pivot with respect to the flat plate 45*b* of the third discharge tray portion 45. When the sheet stoppers 63, 64 are in lying positions, upper surfaces of the sheet stoppers 63, 64 may be flush with or slightly lower than an upper surface of the flat plate 45*b*. When the upstream sheet stopper 63 in a sheet discharging direction is in a standing position, the upstream sheet stopper 63 may receive downstream edges of A4 size sheets. When the downstream sheet stopper 64 is in a standing position while the upstream sheet stopper 63 is in a lying position, the downstream sheet stopper 64 may receive downstream edges of A3 size sheets.

Figure 15:
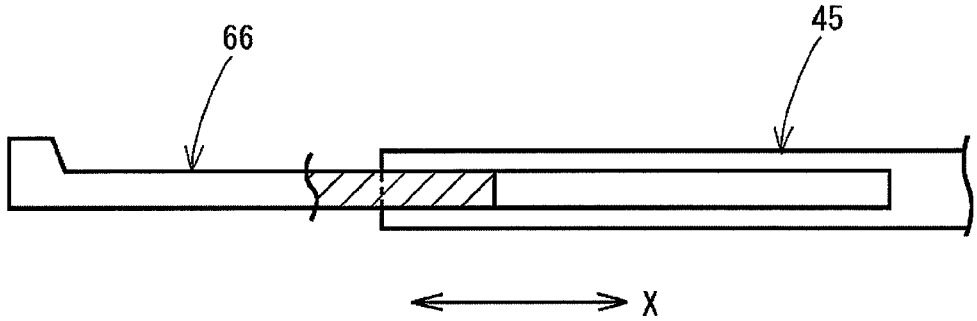
FIG. 15 is a cross-sectional view of a sheet stopper of a discharge tray according to another embodiment of the invention.

In still another embodiment, as shown in FIG. 15, a sheet stopper 66 may be configured to slidably extend from and retract to the flat plate 45*b* of the third discharge tray portion 45 along the X-axis direction.

Before the multi-function device 1 is used or when the multi-function device 1 is packaged for shipment, the discharge tray 40, upper feed tray 20, and lower feed tray 30 are positioned in an initial state in the housing 2. Specifically, as shown in FIG. 7A, the third discharge tray portion 45 is fully retracted to the second discharge tray portion 42, and the second discharge tray portion 42 is fully retracted to the first discharge tray portion 41. The discharge tray 40 is positioned on the upper feed tray 20 in which the second feed tray portion 27 is fully retracted to the first feed tray portion 26. In the lower feed tray 30, the second feed tray portion 37 is fully retracted to the first feed tray portion 36. In this state, the upper feed tray 20 and the lower feed tray 30 are inserted into the opening 14 of the housing 2 such that front surfaces of the upper and lower feed trays 20, 30 are substantially aligned with a front surface of the housing 2. As described before, because the first discharge tray portion 41 is pivotally coupled, via the hinge 43, to the first feed tray portion 26 of the upper feed tray 20, the first discharge tray portion 41 is not allowed to slide along the X-axis direction.

Figure 11A:
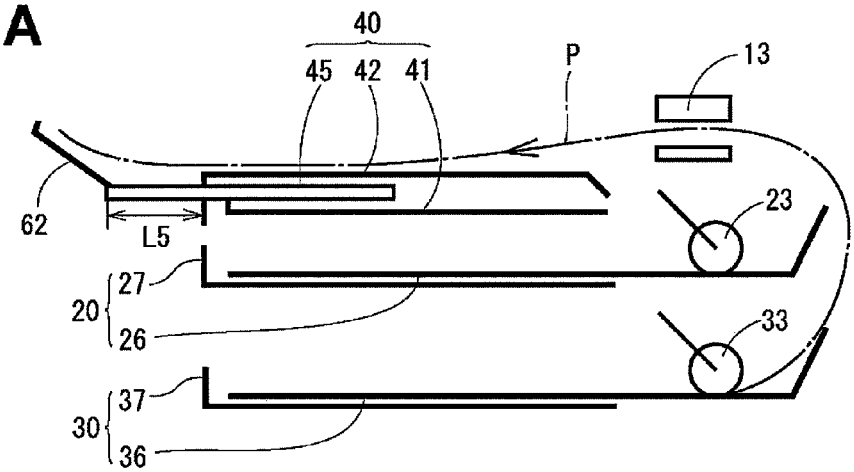
FIG. 11A is a schematic side cross-sectional view of upper and lower feed trays each holding A4 size sheets, in which A4 size sheets are discharged from the lower feed tray.

The multi-function device 1 may be operated for printing (image recording) from the initial state by holding A4 sheets in each of the upper and lower feed trays 20, 30 with their long side extending in the X-axis direction, and by designating one of the upper feed tray 20 and the lower feed tray 30. In this case, as shown in FIGS. 7B and 11A, the third discharge tray portion 45 is extended by the length L5, which is relatively small, from the second discharge tray portion 42, and the sheet stopper 62 is raised into the standing position. When an A4 size sheet P with an image printed thereon is discharged onto the discharge tray 40, the first discharge tray portion 41 and the second discharge tray portion 42 receive the discharged sheet wholly while the sheet stopper 62 contacts a downstream edge of the discharged sheet in the sheet discharging direction. Thus, discharged sheets are stacked on the discharge tray 40 orderly without dropping.

Figure 11B:
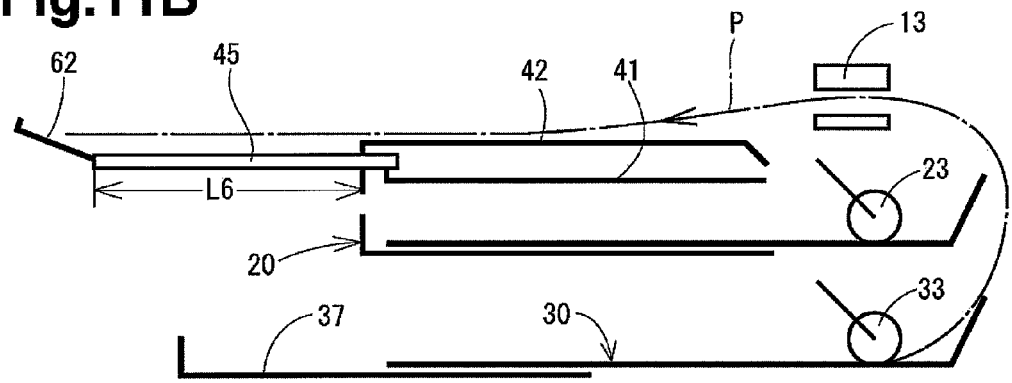
FIG. 11B is a schematic side cross-sectional view of the upper and lower feed trays holding A4 size sheets and A3 size sheets respectively, in which A3 size sheets are discharged from the lower feed tray.

The multi-function device 1 may be operated for printing on a small number of A3 size sheets by designating the lower feed tray 30 when A3 size sheets are held in the lower feed tray 30 and A4 size sheets are held in the upper feed tray 20. In this case, as shown in FIGS. 7C, 8, and 11B, the third discharge tray portion 45 is extended by the length L6, which is relatively great, from the second discharge tray portion 42 while the second discharge tray portion 42 and the second feed tray portion 27 are kept in the fully retracted positions. In addition, the sheet stopper 62 is raised into the standing position. In this way, the length of the discharge tray 40 in the X-axis direction is elongated quickly, and discharged A3 size sheets P are stacked on the discharge tray 40 orderly. The length of the discharge tray 40 in the X-axis direction when the third discharge tray portion is extended by the length L6 from the fully retracted second discharge tray portion 42 is greater than or equal to a length of the A3 size sheets held in the lower feed tray 30.

As described above, when printing on a small number of A3 size sheets to be fed from the lower feed tray 30 is desired, only pulling out the third discharge tray portion 45 from the second discharge tray portion 42 allows the discharge tray 40 to receive discharged A3 size sheets. The third discharge tray portion 45 may be extended from the second discharge tray portion 42 while the upper feed tray 20 is kept in the housing 2, before or during image printing by the recording unit 12. In this case, there is no need to extend the second discharge tray portion 42 integrally with the second feed tray portion 27 of the upper feed tray 20, in accordance with the length of the A3 size sheet.

The multi-function device 1 may be operated for printing by holding A3 sheets in each of the upper and lower feed trays 20, 30 with their long side extending in the X-axis direction, and by designating one of the upper feed tray 20 and the lower feed tray 30. In this case, as shown in FIGS. 4B, 9B, 10, and 11C, the second feed tray portion 27 is fully extended from the first feed tray portion 26 in the upper feed tray 20, and the second feed tray portion 37 is fully extended from the first feed tray portion 36 in the lower feed tray 30, in accordance with the length of the A3 size sheet. In the discharge tray 40, the second discharge tray portion 42 is fully extended from the first discharge tray portion 41, and the third discharge tray portion 45 is extended by the length L5 from the second discharge tray portion 42, and the sheet stopper 62 is raised.

In the above-described state, A3 size sheets P fed from the upper feed tray 20 or the lower feed tray 30 are discharged onto the discharge tray 40 without dropping from the discharge tray 40. In addition, when the third discharge tray portion 45 receives a relatively large number of discharged sheets, the third discharge tray portion 45, even if it has a relatively small rigidity, is unlikely to bend because the extended length L5 is relatively small and a base portion of the third discharge tray portion 45 is supported mostly by the second discharge tray portion 42.

Figure 9A:
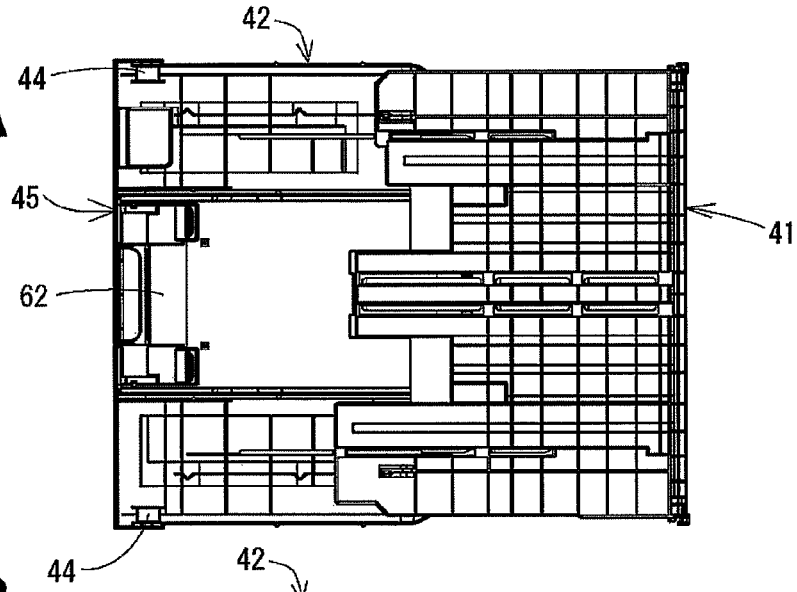
FIG. 9A is a bottom view of the discharge tray in which the second discharge tray portion is extended from a first discharge tray portion.
Figure 9B:
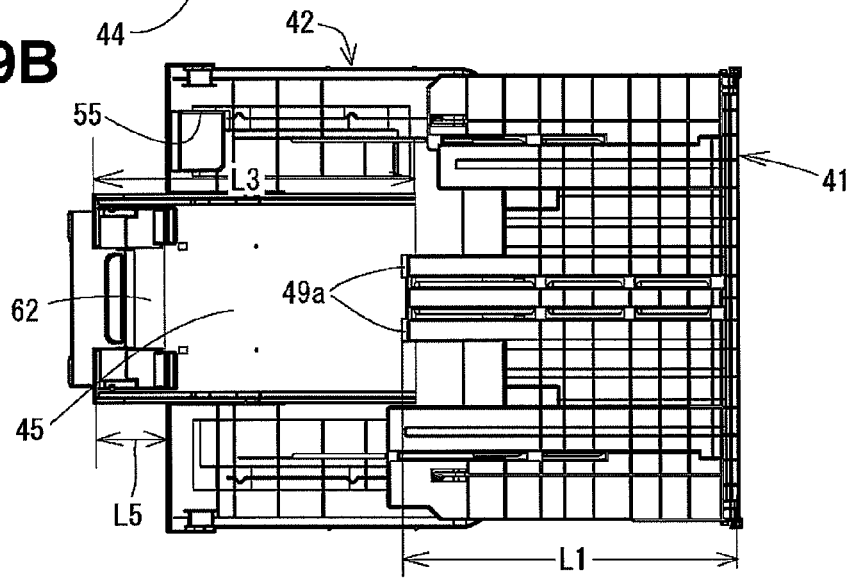
FIG. 9B is a bottom view of the discharge tray in which the third discharge tray portion is extended from the extended second discharge tray portion.
Figure 9C:
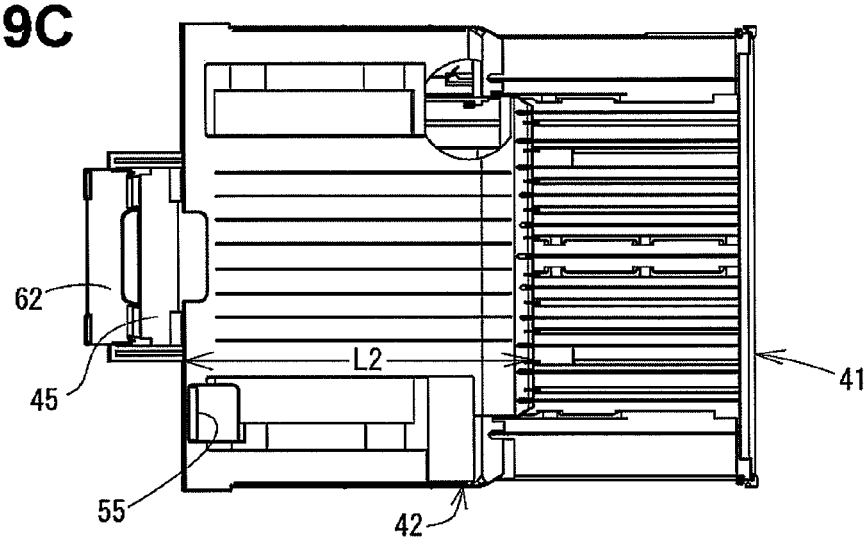
FIG. 9C is a top view of the discharge tray in a state shown in FIG. 9B.
Figure 11C:
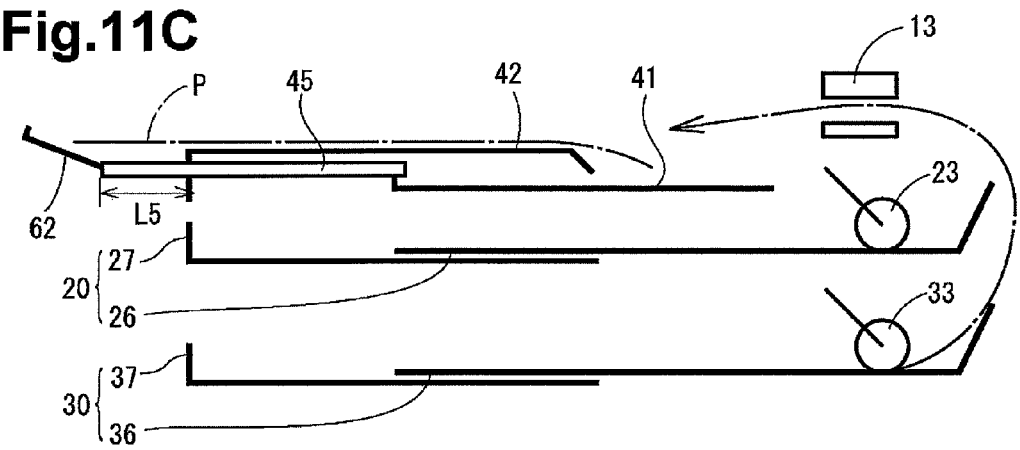
FIG. 11C is a schematic side cross-sectional view of the upper and lower feed trays each holding A3 size sheets in which A3 size sheets are discharged from the lower feed tray.

The extended length of the third discharge tray portion 45 is restricted by engagement between the upward engaging members 49*a* of the first discharge tray portion 41 and the downward engaging members 49*b* of the third discharge tray portion 45. As shown in FIGS. 7C, 8, and 11B, an extended length of the third discharge tray portion 45 from the second discharge tray portion 42, which is fully retracted to the first discharge tray portion 41, is restricted to the length L6, which is relatively great. As shown in FIGS. 9B, 10, and 11C, an extended length of the third discharge tray portion 45 from the second discharge tray portion 42, which is fully extended from the first discharge tray portion 41, is restricted to the length L5, which is smaller than the length L6.

The discharge tray 40 serves as a cover for protecting the sheets in the upper sheet holding portion 25 from dust or the like. The first discharge tray portion 41 and the second discharge tray portion 42 cover entirely a front side of an upper surface of the upper feed tray 20, regardless whether the second feed tray portion 26 is extended or retracted with respect to the second feed tray portion 27. Thus, the discharge tray 40 prevents intrusion of sheet fibers produced during sheet conveyance and dust settled on the multi-function device 1 when not used.

In the above-described embodiment, a width of the third discharge tray portion 45 in the Y-axis direction is smaller than a width of the second discharge tray portion 42, and the third discharge tray portion 45 is disposed at a substantially centered position of the second discharge tray portion 42 in the Y-axis direction. However, the width and position of the third discharge tray portion 45 with respect to the second discharge tray portion 42 may be changed as desired.

In another embodiment, the upper feed tray 20 and the lower feed tray 30 may not be removed from the housing 2 and may be disposed in the housing 2 such that they extend from and retract into the housing 2.

In another embodiment, three or more feed trays may be arranged vertically. In this case, the discharge tray 40 as described above may be disposed on the uppermost feed tray.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet tray unit comprising:

a particular feed tray configured to hold one or more sheets therein; and a discharge tray disposed on the particular feed tray and configured to receive a discharged sheet, the discharge tray comprising:

a first discharge tray portion;

a second discharge tray portion supported by the first discharge tray portion and configured to slide with respect to the first discharge tray portion in a first direction and in a second direction, wherein the second direction is opposite and substantially parallel to the first direction; and a third discharge tray portion supported by the second discharge tray portion and configured slide with respect to the second discharge tray portion in the first direction and in the second direction, wherein the first discharge tray portion comprises a tray stopper comprising a first engaging member, wherein the third discharge tray portion comprises a second engaging member, and wherein, when the third discharge tray portion slides in the first direction and reaches a predetermined position with respect to the first discharge tray portion, the first engaging member of the tray stopper of the first discharge tray portion directly engages with the second engaging member of the third discharge tray portion, such that the tray stopper prevents the third discharge tray portion from sliding beyond the predetermined position in the first direction.

2. The sheet tray unit according to claim 1, wherein:

the second discharge tray portion is configured to slide on an upper surface of the first discharge tray portion, and the third discharge tray portion is configured to slide between a lower surface of the second discharge tray portion and the upper surface of the first discharge tray portion.

3. The sheet tray unit according to claim 1, wherein the third discharge tray portion is disposed at a substantially centered position of the second discharge tray portion in a direction perpendicular to the first direction.

4. The sheet tray unit according to claim 1, wherein one of the second discharge tray portion and the third discharge tray portion comprises a guide rail extending in the first direction, and the other of the second discharge tray portion and the third discharge tray portion comprises a guide groove extending in the first direction and configured to engage with the guide rail.

5. The sheet tray unit according to claim 4, wherein a third engaging member is formed on a longitudinally intermediate portion of the guide rail, and a fourth engaging member is formed on a longitudinally intermediate portion of the guide groove, wherein when the third discharge tray portion slides with respect to the second discharge tray portion, the third engaging member engages with the fourth engaging member and generates a sensory feedback to a user.

6. The sheet tray unit according to claim 5, wherein the sensory feedback is a sound audible to a user.

7. The sheet tray unit according to claim 1, wherein the second discharge tray portion is configured to slide between a first position and a second position, wherein the first position is a fully extended position in the first direction with respect to the first discharge tray portion, and the second position is a fully retracted position in the second direction with respect to the first discharge tray portion.

8. The sheet tray unit according to claim 7, wherein when the second discharge tray portion is positioned at the second position and the tray stopper of the first discharge tray portion prevents sliding of the third discharge tray portion beyond the predetermined position, the third discharge tray portion is extended by a first length from the second discharge tray portion, and when the second discharge tray portion is positioned at the first position and the tray stopper of the first discharge tray portion prevents sliding of the third discharge tray portion beyond the predetermined position, the third discharge tray portion is extended by a second length from the second discharge tray portion, and the first length is greater than the second length.

9. The sheet tray unit according to claim 7, wherein when the third discharge tray portion is fully retracted with respect to the second discharge tray portion in the second direction, and the second discharge tray portion is positioned at the second position, one end in the first direction of the third discharge tray portion is aligned with one end of the second discharge tray portion.

10. The sheet tray unit according to claim 1, wherein the discharge tray further comprises a sheet stopper configured to pivot with respect to an upper surface of the third discharge tray portion and to receive a leading edge of the discharged sheet.

11. The sheet tray unit according to claim 1, wherein the discharge tray further comprises a sheet stopper configured to slide in the first direction and in the second direction with respect to the third discharge tray portion and to receive a leading edge of the discharged sheet.

12. The sheet tray unit according to claim 1, wherein the particular feed tray comprises a first feed tray portion and a second feed tray portion, and the second feed tray portion is configured to slide with respect to the first feed tray portion in the first direction and in the second direction.

13. The sheet tray unit according to claim 12, wherein the second discharge tray portion is configured to removably engage with the second feed tray portion, and when the second discharge tray portion engages with the second feed tray portion, the second discharge tray portion is configured to slide integrally with the second feed tray portion, such that the second discharge tray portion slides with respect to the first discharge tray portion as the second feed tray portion slides with respect to the first feed tray portion.

14. The sheet tray unit according to claim 12, wherein the first discharge tray portion is coupled at one end in the second direction to the particular feed tray, such that the first discharge tray portion pivots vertically about the coupled one end.

15. The sheet tray unit according to claim 1, further comprising a further feed tray configured to hold sheets therein, and disposed under the particular feed tray, wherein the further feed tray comprises a third feed tray portion and a fourth feed tray portion, and the fourth feed tray portion is configured to slide with respect to the third feed tray potion in the first direction and in the second direction.

16. The sheet tray unit according to claim 1, wherein a width of the third discharge tray portion in a direction perpendicular to the first direction is smaller than a width of the second discharge tray portion in the direction perpendicular to the first direction.

17. An image recording device comprising:

a housing having an opening;

a recording unit disposed in the housing and configured to record an image on a sheet; and a sheet tray unit configured to be removably inserted into the housing through the opening, the sheet tray unit comprising:

a particular feed tray configured to hold one or more sheets to be fed to the recording unit therein; and a discharge tray disposed on the particular feed tray and configured to receive a sheet discharged from the recording unit, the discharge tray comprising:

a first discharge tray portion;

a second discharge tray portion supported by the first discharge tray portion and configured to slide with respect to the first discharge tray portion in a first direction and in a second direction, wherein the second direction is an insertion direction of the sheet tray unit into the housing and is opposite to the first direction; and a third discharge tray supported by the second discharge tray portion and configured to slide with respect to the second discharge tray portion in the first direction and in the second direction, wherein the first discharge tray portion comprises a tray stopper comprising a first engaging member, wherein the third discharge tray portion comprises a second engaging member, and wherein, when the third discharge tray portion slides in the first direction and reaches a predetermined position with respect to the first discharge tray portion, the first engaging member of the tray stopper of the first discharge tray portion directly engages with the second engaging member of the third discharge tray portion, such that the tray stopper prevents the third discharge tray portion from sliding beyond the predetermined position in the first direction.

18. The image recording device according to claim 17, wherein the sheet tray unit further comprises a further feed tray configured to hold one or more sheets to be fed to the recording unit therein, and configured to be removably inserted into the housing through the opening in the second direction into a position under the particular feed tray, wherein the further feed tray is configured to hold a maximum size of the one or more sheets that is greater than or equal to a maximum size of the one or more sheets that the particular feed tray is configured to hold, and wherein when the first discharge tray portion prevents the third discharge tray portion from sliding in the first direction beyond the predetermined position, the discharge tray has a length, when measured parallel to the first direction, that is greater than or equal to a length of the maximum size of the sheets that the further feed tray is configured to hold.

19. The image recording device according to claim 17, wherein the particular feed tray comprises a first feed tray portion and a second feed tray portion, and the second feed tray portion is configured to slide with respect to the first feed tray portion in the first direction and in the second direction.

* * * * *